US008567913B2

(12) United States Patent
Casella et al.

(10) Patent No.: US 8,567,913 B2
(45) Date of Patent: Oct. 29, 2013

(54) MULTIPLE PRIMING HOLES FOR IMPROVED FREEZE/THAW CYCLING OF MEMSJET PRINTING DEVICES

(75) Inventors: James M. Casella, Webster, NY (US); Andrew W. Hays, Fairport, NY (US); Peter M. Gulvin, Webster, NY (US); Jun Ma, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 439 days.

(21) Appl. No.: 12/792,062

(22) Filed: Jun. 2, 2010

(65) Prior Publication Data

US 2011/0298870 A1 Dec. 8, 2011

(51) Int. Cl.
*B41J 2/14* (2006.01)
*B41J 2/16* (2006.01)

(52) U.S. Cl.
USPC ..... 347/47

(58) Field of Classification Search
USPC ..... 347/47, 49, 25, 30, 35
See application file for complete search history.

(56) References Cited

U.S. PATENT DOCUMENTS

| | | | | |
|---|---|---|---|---|
| 6,007,193 | A * | 12/1999 | Kashimura et al. | 347/92 |
| 6,485,126 | B1 * | 11/2002 | Kato et al. | 347/54 |
| 7,625,080 | B2 * | 12/2009 | Hess et al. | 347/92 |
| 7,682,009 | B1 * | 3/2010 | Sliwa et al. | 347/95 |
| 2008/0238997 | A1 * | 10/2008 | Nystrom et al. | 347/41 |
| 2011/0228005 | A1 * | 9/2011 | Gulvin et al. | 347/47 |

OTHER PUBLICATIONS

Wikipedia Article: Polysilicon; Introduction Section; p. 1.*

* cited by examiner

*Primary Examiner* — Lisa M Solomon
(74) *Attorney, Agent, or Firm* — MH2 Technology Law Group LLP

(57) ABSTRACT

An ink jet print head includes an ink chamber defined by an electrostatically actuated membrane and a nozzle plate opposing the membrane. The nozzle plate includes a nozzle hole and a group of priming holes, the priming holes configured to maintain a substantially ink free surface on the nozzle plate during a freeze thaw cycle of ink in the ink chamber. A method for accommodating expansion and contraction of ink during a freeze thaw cycle of ink in an ink chamber is also provided. The method includes providing a group of priming holes in a nozzle plate of the ink chamber, the group of priming holes maintaining a substantially ink free surface on the nozzle plate during the freeze thaw cycle.

19 Claims, 4 Drawing Sheets

MULTIPLE PRIMING HOLES FOR IMPROVED FREEZE/THAW CYCLING OF MEMSJET PRINTING DEVICES

DESCRIPTION OF THE INVENTION

1. Field of the Invention

This invention relates generally to imaging and, more particularly, to a nozzle plate of an ink jet print head, the nozzle plate having a group of priming holes configured to maintain a substantially ink free surface on the nozzle plate during a freeze thaw cycle of ink in the ink jet print head.

2. Background of the Invention

In known MEMSJet (micro-electromechanical ink jet) print head technology, a freeze/thaw cycle causes a corresponding contraction and expansion of ink within an ink chamber of the print head. As used herein, the phrase "freeze thaw" refers to an ink temperature during ambient conditions, for example about 21° C., and an ink temperature during operation or active use of an ink jet print head, for example about 120° C. As used herein, the freeze/thaw cycle can occur during normal inactivity and operation of an ink jet print head and during an event such as a power outage which would suddenly change an operating status of the ink jet print head, thereby affecting a temperature of the ink therein. The expansion and contraction of ink due to thermal freeze/thaw cycling has caused about a 15% fracture rate of silicon membranes (the ink prime mover) within a baseline die configuration. Fracture of these membranes causes ink to leak through the membrane into underlying air vents and ultimately short the electrical field that is needed to pull (and ultimately release) the membrane from its electrically conductive landing pad. A current solution to this problem has been to deprime (e.g. purge) ink from the ink chamber of the head prior to a power down (freeze) condition of the printer. This solution, however, doesn't work in power outage type situations, requiring the need for more robust type solutions to solve this problem.

It would, therefore, be desirable to prevent stress to and resultant fracture of the membrane as a result of the freeze/thaw cycling, without having to deprime the ink chamber of the ink jet print head.

SUMMARY OF THE INVENTION

According to various embodiments, the present teachings include an ink jet print head. The ink jet print head can include an ink chamber defined by an electrostatically actuated membrane and a nozzle plate opposing the membrane; the nozzle plate comprising a nozzle hole and a group of priming holes, the priming holes configured to maintain a substantially ink free surface on the nozzle plate during a freeze/thaw cycle of ink in the ink chamber.

According to various embodiments, the present teachings include an ink jet print head. The ink jet print head can include an ink chamber defined by an electrostatically actuated membrane and a nozzle plate opposing the membrane; the nozzle plate comprising a nozzle hole and a group of priming holes, the priming holes configured to accommodate expansion and contraction of ink during a freeze/thaw cycle of ink in the ink chamber.

According to various embodiments, the present teachings include a method for accommodating expansion and contraction of ink during a freeze/thaw cycle of ink in an ink chamber. The method can include providing a group of priming holes in a nozzle plate of the ink chamber, the group of priming holes maintaining a substantially ink free surface on the nozzle plate during the freeze/thaw cycle.

Additional embodiments of the invention will be set forth in part in the description which follows, and in part will be learned by practice of the invention. The embodiments of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the present technology and together with the description, serve to explain the principles of the present technology.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to the present embodiments (exemplary embodiments), examples of which are illustrated in the accompanying drawings. Wherever possible, the same reference numbers will be used throughout the drawings to refer to the same or like parts. In the following description, reference is made to the accompanying drawings that form a part thereof, and in which is shown, by way of illustration, specific exemplary embodiments in which the present teachings may be practiced. These embodiments are described in sufficient detail to enable those skilled in the art to practice the invention and it is to be understood that other embodiments may be utilized and that changes may be made without departing from the scope of the present teachings. The following description is, therefore, merely exemplary.

Figure 1:
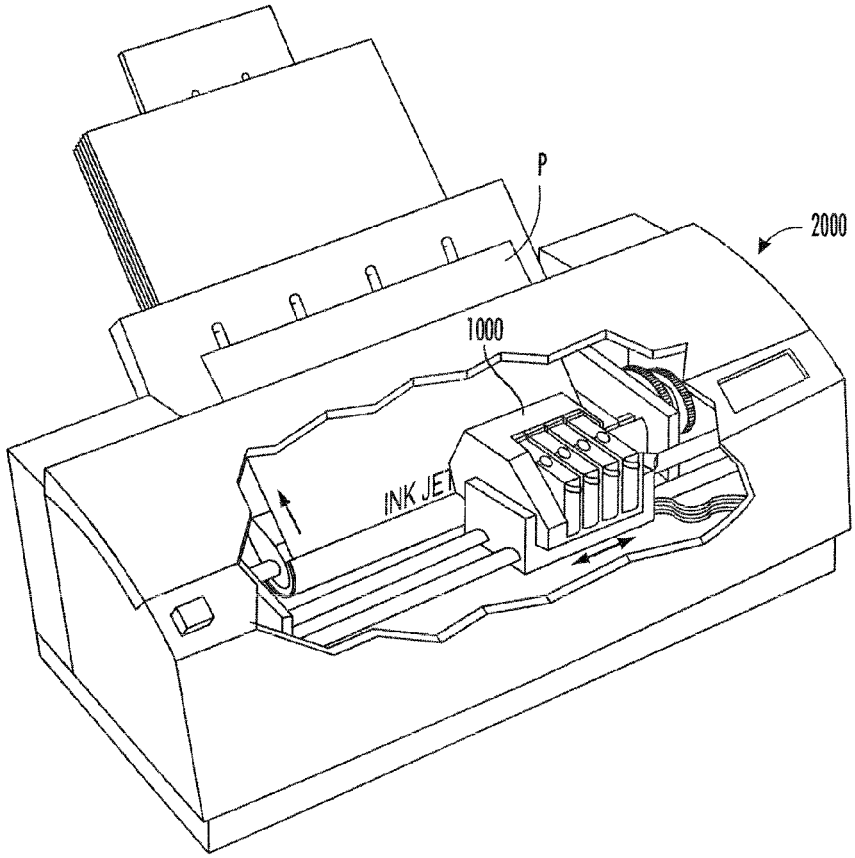
FIG. 1 is a perspective depiction of an exemplary ink jet printer in accordance with the present teachings.

FIG. 1 depicts an exemplary ink jet print printer 2000 in accordance with the present teachings. It should be readily apparent to one of ordinary skill in the art that the ink jet printer 2000 depicted in FIG. 1 represents a generalized schematic illustration and that other components can be added or existing components can be removed or modified.

As shown in FIG. 1, one or more fluid drop ejectors 1000 can be incorporated into the ink jet printer 2000, to eject droplets of ink onto a substrate P. The individual fluid drop ejectors 1000 can be operated in accordance with signals derived from an image source to create a desired printed image on print medium P. Printer 2000 can take the form of the illustrated reciprocating carriage printer that moves a printhead in a back and forth scanning motion, or of a fixed type in which the print substrate moves relative to the printhead.

The carriage type printer can have a printhead having a single die assembly or several die assemblies abutted together for a partial width size printhead. Because both single die and multiple-die partial width printheads function substantially the same way in a carriage type printer, only the printer with a single die printhead will be discussed. The only difference, of course, is that the partial width size printhead will print a larger swath of information. The single die printhead, containing the ink channels and nozzles, can be sealingly attached to a disposable ink supply cartridge, and the combined printhead and cartridge assembly is replaceably attached to a carriage that is reciprocated to print one swath of information at a time, while the recording medium is held stationary. Each swath of information is equal to the height of the column of nozzles in the printhead. After a swath is printed, the recording medium P is stepped a distance at most equal to the height of the printed swath, so that the next printed swath is contiguous or overlaps with the previously printed swath. This procedure is repeated until the entire image is printed. Exemplary embodiments herein can be incorporated in both types of ink jet print head.

Figure 2A:
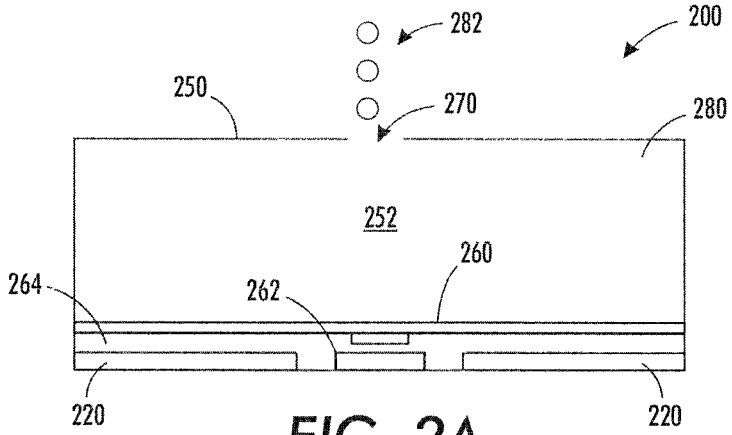
FIG. 2A is a side view depicting a baseline MEMSJet ink chamber geometry at an operating temperature.
Figure 2B:
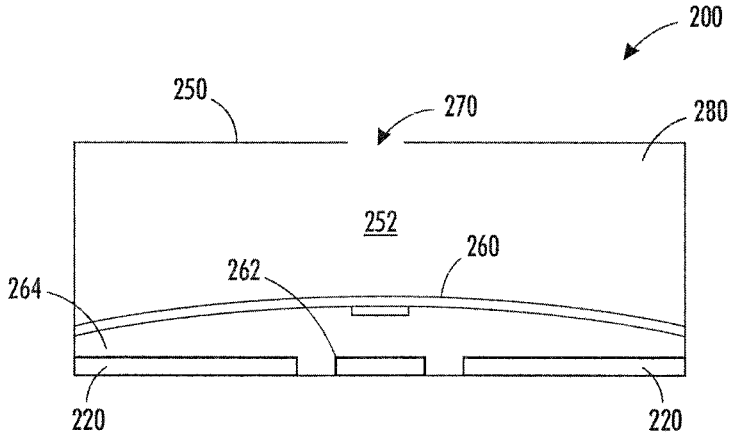
FIG. 2B is a side view of the MEMSJet ink chamber of FIG. 2A at a freeze temperature.

FIG. 2A depicts a baseline of a MEMSJet print head 200 geometry at an operating temperature of 120° C. FIG. 2B depicts a freeze condition of about 21° C., of the same geometry. In FIGS. 2A and 2B, each print head 200 includes an electrode 220 formed on a substrate (not shown), an ink chamber 252 filled with ink 280, electrostatically actuated membrane 260, a landing pad 262 formed on the substrate substantially planar with the electrodes 220, a nozzle plate 250 having a nozzle hole 270, and air vents 264 between the electrodes 220 and membrane 260. The landing pad 262 serves to prevent the membrane 260, which is grounded, from touching electrically active electrodes and shorting.

During a freeze, which would occur during a power off (or power outage) condition of an ink jet printer, the ink will shrink about 18% as the ink temperature drops from 120° C. (operating) to 21° C. (lab ambient). Because adhesion between the ink chamber 252 walls, membrane 260 and underside of the nozzle plate 250 is high, any volume change of ink in the ink chamber is made up from either the ink inlet (believed to be negligible because ink in this location is also shrinking) or from membrane 260 deflections. FIG. 2B illustrates such a freeze condition, showing how ink shrinkage causes the membrane 260 to be deflected into the ink chamber 252 during a freeze.

Test results of MEMSJet die show that this cycling from operating to freeze temperature results in about a 15% fracture rate of the silicon membranes. Once a membrane 260 cracks, ink leaks through into the underlying air vents 264 and ultimately short the electrical field that is needed to pull (and ultimately release) the membrane 260 from its electrically conductive landing pad 262.

Figure 3:
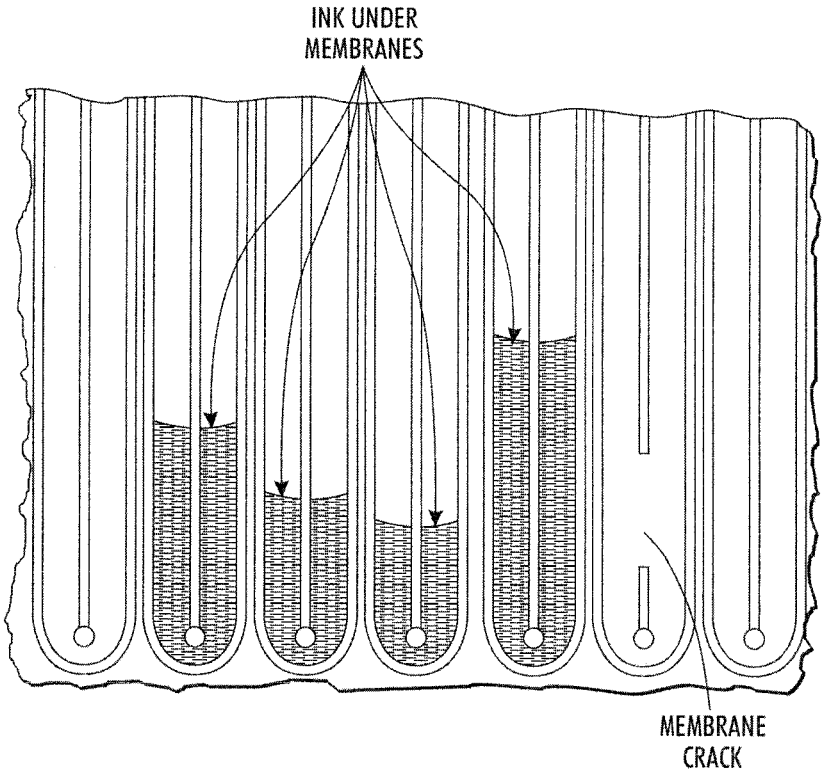
FIG. 3 is a cross section depicting ink chambers after a freeze test.

FIG. 3 is a cross section depicting seven ink chambers after a freeze test which illustrates both "ink under the membrane" and "membrane cracks" failures as they appeared in a known print head.

Figure 4:
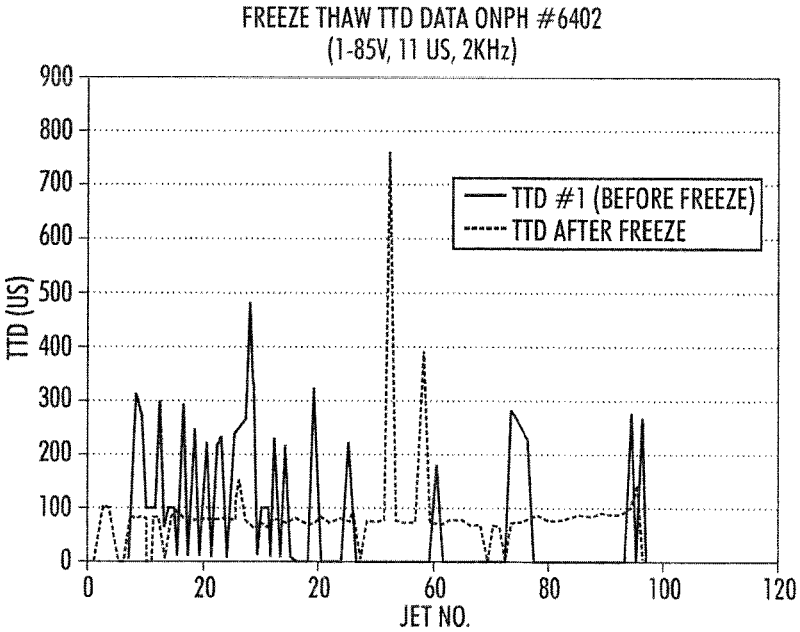
FIG. 4 is a chart depicting time to drum jetting performance before and after a freeze.

When such freeze damage occurs to the membrane, the entire print head will shortly become totally unusable, with the ink underneath shorting the device and/or immobilizing the membrane. As ink starts to fill in portions of various membranes, the initial effect is that the TTD (Time to Drum) jetting performance is degraded. Test data, illustrated in FIG. 4, shows about 75% of initial working jets failed after a thermal freeze, with the remaining working jets firing about three times slower than initially measured.

Figure 5A:
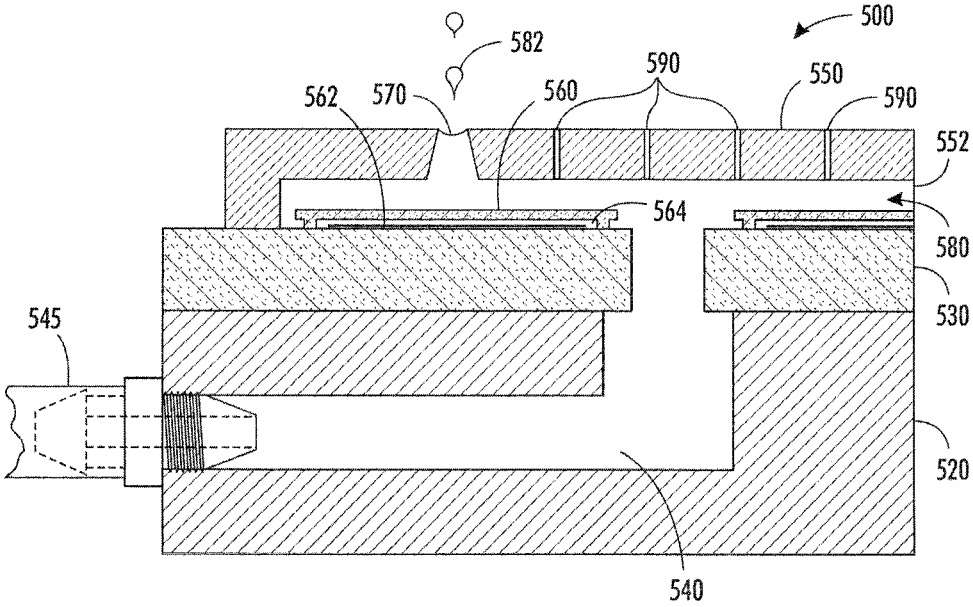
FIG. 5A is a side view depicting an exemplary ink jet print head, in accordance with the present teachings.
Figure 5B:
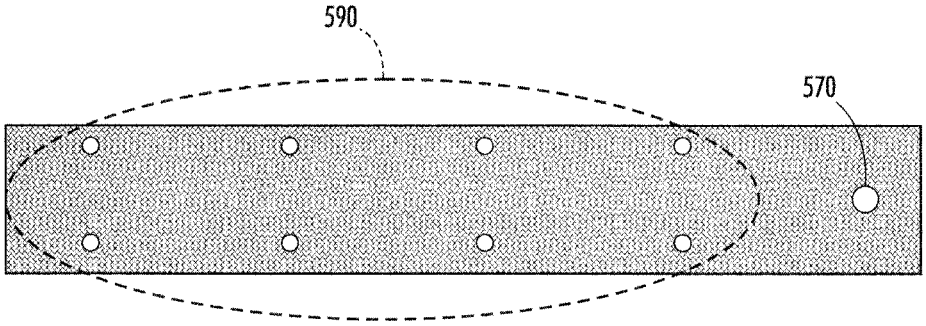
FIG. 5B is a top view of a nozzle plate of the ink jet print head of FIG. 5A in accordance with the present teachings.

FIG. 5A is a side view of an exemplary print head 500 and FIG. 513 is a top plan view of an exemplary nozzle plate 550 of the print head 500 in accordance with the present teachings. The exemplary print head 500 can be used, for example, in the ink jet printer 2000 of FIG. 1. It should be readily apparent to one of ordinary skill in the art that the print head 500 and nozzle plate 550 depicted in FIGS. 5A and 5B represent generalized schematic illustrations and that other components can be added or existing components can be removed or modified.

The exemplary print head 500 can be an electrostatically actuated print head. The print head 500 can include a substrate 520, a silicon wafer 530 on an upper surface of the substrate 520, an ink passage 540 through the substrate 520 and silicon wafer 530, a tube 545 connecting the ink passage 540 of the print head 500 to an ink supply reservoir, and a nozzle plate 550 mounted on the structure. An electrostatically actuated membrane 560 can be formed on the silicon wafer 530 as shown. A nozzle hole 570 and a matrix of priming holes 590 (FIG. 5B) can be formed in the nozzle plate 550.

In the print head 500, the membrane 560 can be an electrostatically actuated diaphragm, in which the membrane 560 is controlled by an electrode 562. The membrane 560 can be made from a structural material such as, for example, polysilicon, as is typically used in a surface micromachining process. An air vent 564 between membrane 560 and wafer 530 can be formed using typical techniques, such as by surface micromachining. The electrode 562 acts as a counterelectrode and is typically either a metal or a doped semiconductor material, such as polysilicon.

The nozzle plate 550 is located above electrostatically actuated membrane 560, forming an ink chamber 552 between the nozzle plate 550 and the membrane 560. Nozzle plate 550 can include nozzle hole 570 formed therein. Fluid, e.g. ink, 580 can be fed into the ink chamber 552 from a fluid reservoir (not shown). The ink chamber 552 can be separated from the fluid reservoir by a check valve to restrict fluid flow from the fluid reservoir to the ink chamber 552. The membrane 560 can be initially pulled-down by an applied voltage or current. Ink fills in the volume created by the membrane deflection.

When a bias voltage or charge is eliminated, the membrane 560 relaxes, increasing pressure in the ink chamber 552. As the pressure increases, ink 580 is forced out of the nozzle hole 570 as discrete fluid drops 582. For constant volume or constant drop size fluid ejection, the membrane 560 can be actuated using a voltage drive mode, in which a constant bias voltage is applied between the parallel plate conductors that form the membrane and the conductor.

The nozzle plate 550 can include a nozzle hole 570 and the matrix of priming holes 590. The priming holes 590 can be a group of small nozzle holes ("priming holes") in the MEMSJet nozzle plate 550. Air can enter and leave the ink chamber 552 during freeze/thaw conditions of the print head 500 through the group of priming holes 590. By adding the priming holes 590 in the nozzle plate 550 that are small enough so that they won't jet or cause significant compliance, air is able to enter the system in many locations during ink freezing. Because of the ingress/egress of air into the ink chamber 552 during freeze thaw cycles, ink will not adhere to the inner surface of the nozzle plate 550. With the removed adhesion of ink to the nozzle plate 550, when ink is in a freeze condition, it cannot pull on or stress the membrane 560 in the direction of the nozzle plate 550. This reduced stress level on the membrane 560 can eliminate membrane failures entirely.

Additionally, this group of priming holes 590 can allow air bubbles to be more easily cleared, decreasing required purge volumes.

It will be appreciated that the exemplary structure can be implemented using any printhead with silicon nozzle plates. It will be further appreciated that the matrix of priming holes 590 shown can be in any suitable pattern and number to allow ingress and egress of air to the ink chamber 552.

Because the priming holes 590 are so much smaller than the nozzle holes 570 (ideally as small as the technology will allow), surface tension of the meniscuses is so high that the priming hole 590 will not jet or weep. The pressure at which a nozzle weeps is the inverse of the hole diameter, and the priming holes can be made to be from about 5 to about 10 times smaller than a diameter of the nozzle holes 570. Because there is little net flow through the priming holes 590 (they don't jet), they are unlikely to completely clog. However, redundant priming holes can be added as insurance.

The priming holes 590 can be about 3 to about 5 microns in diameter, so very little ink flow, if any, is expected from these openings. In comparison, the baseline nozzle diameter for each chamber is about 27.5 microns. The small size of the priming holes 590 can also minimize the impact they have on the compliance of the system, allowing more of the pressure within the print head to go towards jetting drops.

During manufacture, the priming holes 590 can be made at the same time as the nozzle holes 570, so there is no extra cost associated with the priming holes at the manufacturing stage. An additional benefit is that the priming holes 590 generally make it easier to purge air out of the system, thereby decreasing the purge of ink the significant cost associated with expelling unnecessary ink. For both silicon and laser-etched nozzles, the addition of priming holes 590 would only require an additional feature drawn on a mask.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An ink jet print head comprising:

an ink chamber defined by an electrostatically actuated membrane and a nozzle plate opposing the membrane;

an ink passage configured to supply ink to the ink chamber; and the nozzle plate comprising a nozzle hole and a group of priming holes, the priming holes opening into the ink chamber and configured to maintain a substantially ink free surface on the nozzle plate during a freeze thaw cycle of ink in the ink chamber by air introduced into the ink chamber through the priming holes, wherein no priming hole opens into the ink passage.

2. The ink jet print head of claim 1, wherein the group of priming holes enable ingress and egress of the air into the ink chamber.

3. The ink jet print head of claim 2, the ingress and egress of the air effectively reducing membrane stress during ink shrinkage and expansion in the freeze thaw cycle of ink.

4. The ink jet print head of claim 1, wherein the group of priming holes comprises a plurality of priming holes.

5. The ink jet print head of claim 1, wherein a priming hole comprises a diameter opening of about 3 to about 5 microns in diameter.

6. The ink jet print head of claim 1, wherein the electrostatically actuated membrane comprises a silicon membrane.

7. The ink jet print head of claim 1, wherein the group of priming holes are sized to prevent jetting or weeping of ink during operation of the ink chamber.

8. The ink jet print head of claim 1, wherein a diameter of a priming hole is from about 5 to about 10 times smaller than a diameter of a nozzle hole in the same nozzle plate.

9. The ink jet print head of claim 1, wherein the group of priming holes further evacuate the air from the ink chamber during priming and purging of the ink chamber.

10. The ink jet print head of claim 1, wherein the ink chamber is directly interposed between at least one priming hole of the group of priming holes and the electrostatically actuated membrane.

11. An ink jet print head comprising:

an ink chamber defined by an electrostatically actuated membrane and a nozzle plate opposing the membrane; and the nozzle plate comprising a nozzle hole and a group of priming holes, the priming holes opening into the ink chamber and configured to maintain a substantially ink free surface on the nozzle plate during a freeze thaw cycle of ink in the ink chamber by air introduced into the ink chamber through the priming holes, wherein the ink chamber is directly interposed between at least one priming hole of the group of priming holes and the electrostatically actuated membrane.

12. The ink jet print head of claim 11, wherein the group of priming holes enable ingress and egress of the air into the ink chamber.

13. The ink jet print head of claim 12, the ingress and egress of the air effectively reducing membrane stress during ink shrinkage and expansion in the freeze thaw cycle of ink.

14. The ink jet print head of claim 12, wherein the group of priming holes comprises a plurality of priming holes.

15. The ink jet print head of claim 12, wherein a priming hole comprises a diameter opening of about 3 to about 5 microns in diameter.

16. The ink jet print head of claim 12, wherein the electrostatically actuated membrane comprises a silicon membrane.

17. The ink jet print head of claim 12, wherein the group of priming holes are sized to prevent jetting or weeping of ink during operation of the ink chamber.

18. The ink jet print head of claim 12, wherein a diameter of a priming hole is from about 5 to about 10 times smaller than a diameter of a nozzle hole in the same nozzle plate.

19. The ink jet print head of claim 12, wherein the group of priming holes further evacuate the air from the ink chamber during priming and purging of the ink chamber.

* * * * *